US007461683B2

(12) United States Patent
Wang

(10) Patent No.: US 7,461,683 B2
(45) Date of Patent: Dec. 9, 2008

(54) CURTAIN ROLLING BUFFER APPARATUS

(76) Inventor: Wen-Jen Wang, No. 49, Ren-Ai Rd., Ren-Ho Village, Linbian Township, Pingtung County (TW)

( * ) Notice: Subject to any disclaimer, the term of this patent is extended or adjusted under 35 U.S.C. 154(b) by 660 days.

(21) Appl. No.: 11/067,328

(22) Filed: Feb. 28, 2005

(65) Prior Publication Data

US 2006/0191649 A1 Aug. 31, 2006

(51) Int. Cl.
*E06B 9/56* (2006.01)

(52) U.S. Cl. ..... 160/296; 160/291; 160/305; 188/296; 188/307

(58) Field of Classification Search ..... 160/313, 160/296, 293.1, 310, 312, 23.1, 291, 305, 160/323.1; 296/97.4; 188/296, 307, 308, 188/290, 291, 281, 292
See application file for complete search history.

(56) References Cited

U.S. PATENT DOCUMENTS 3,179,161 A * 4/1965 Johnson ..... 160/313
4,432,254 A * 2/1984 Schultz ..... 74/573.1
4,487,245 A * 12/1984 Shinohara et al. ..... 160/313
4,535,829 A * 8/1985 Fukuchi ..... 160/291
4,751,953 A * 6/1988 Appel et al. ..... 160/313
5,934,354 A * 8/1999 Price et al. ..... 160/370.22
6,155,328 A * 12/2000 Welfonder ..... 160/313
6,158,563 A * 12/2000 Welfonder et al. ..... 192/223.3
6,443,210 B1 * 9/2002 Welfonder ..... 160/313
6,591,890 B1 * 7/2003 Grubb et al. ..... 160/296
6,666,252 B2 * 12/2003 Welfonder ..... 160/296
6,729,447 B2 * 5/2004 Takahashi ..... 188/291
6,799,738 B2 * 10/2004 Sauder et al. ..... 242/381
6,854,505 B2 * 2/2005 Grubb et al. ..... 160/296
6,938,667 B2 * 9/2005 Sugiyama et al. ..... 160/296
7,360,736 B2 * 4/2008 Zangirolami ..... 242/422.2
2004/0099495 A1 * 5/2004 Hayashi ..... 188/290

* cited by examiner

*Primary Examiner*—Katherine W Mitchell
*Assistant Examiner*—Jaime F Cardenas-Garcia
(74) *Attorney, Agent, or Firm*—Muncy, Geissler, Olds & Lowe, PLLC

(57) ABSTRACT

An improved curtain rolling buffer apparatus mainly includes a rolling means mounted to a left end of the track to allow the curtain hanging below the track to be extended by pulling once and retracted by pulling another time. A buffer means is located on the right end of the track and has a bushing housing a spring. When to extend or retract the curtain, the spring is turned clockwise and extended outwards, and runs idle outside an axle, and the elastic force of the spring is small than the pressure of lube oil so that the curtain is easier to be extended. On the contrary, when the spring is turned counterclockwise, it is tightened and drives the bushing to rotate together.

3 Claims, 5 Drawing Sheets

CURTAIN ROLLING BUFFER APPARATUS

FIELD OF THE INVENTION

The present invention relates to an improved curtain rolling buffer apparatus for achieving smooth curtain rolling without generating noise.

BACKGROUND OF THE INVENTION

Window coverings such as curtains, draperies, shades and blinds have been widely used in households and office environments. The extension or retraction of the curtains mostly are done through pulling cords. This type of operation generally is adapted for Venetian blinds or curtains composed of a left and a right panel, but is not adaptable to one-piece curtain. Applicant has disclosed a curtain apparatus which includes an actuating means located on the left end of the track. Pulling the actuating means once, the curtain will be extended clockwise downward. Pulling one more time, the curtain will be retracted counterclockwise upward. When the curtain is retracted, a buffer apparatus located on the right end of the track will be wound slowly. However, when the curtain is retracted, the friction coefficient of the buffer apparatus is relatively large and will generate noise.

SUMMARY OF THE INVENTION

In view of the foregoing disadvantages, the primary object of the invention is to provide an improved buffer apparatus that includes a casing containing lube oil for damping to reduce noise too much friction coefficient during curtain retracting operation. The buffer apparatus for rolling curtains according to the invention mainly consists of a bushing which has an axle surrounded by a spring. The bushing is coupled with a hub. The bushing further has a jutting ring coupled with an oil seal and covered by a cap to prevent lube oil contained between the bushing and casing from leaking out. When the spring in the bushing is turned clockwise and extended outwards, the spring is running idle on the axle. The spring force is small than the lube oil pressure hence the curtain may be pulled and extended easily. When the spring is turned counterclockwise, the spring is under contraction and tightened. The lube oil outside the bushing generates a resistance and reaction force in the opposite direction to lower the rolling speed of the curtain and prevent the noise from generating.

The principle and construction of the invention set forth above have the following advantages:

1. When the curtain is being retracted, the noise resulting from too much friction coefficient will be greatly reduced. As a result, the invention offers quiet operation without generating irritating sound.
2. When to extend the curtain, the buffer means located on the right hand side of that track has lube oil disposed outside the bushing to allow the spring surrounding the axle of the bushing to rotate clockwise and extended outwards. Hence the spring runs idle outside the axle, and the spring force is small than the pressure of the lube oil to enable the curtain to be extended smoothly. On the contrary, when the spring is turned counterclockwise, it is tightened and drives the bushing to rotate counterclockwise. The bushing will be retarded by the lube oil and generate a reaction force in the inverse direction to slow down the rolling speed of the curtain. Hence the curtain may be wound and retracted slowly without forming creases or being damaged caused by speedy retraction.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
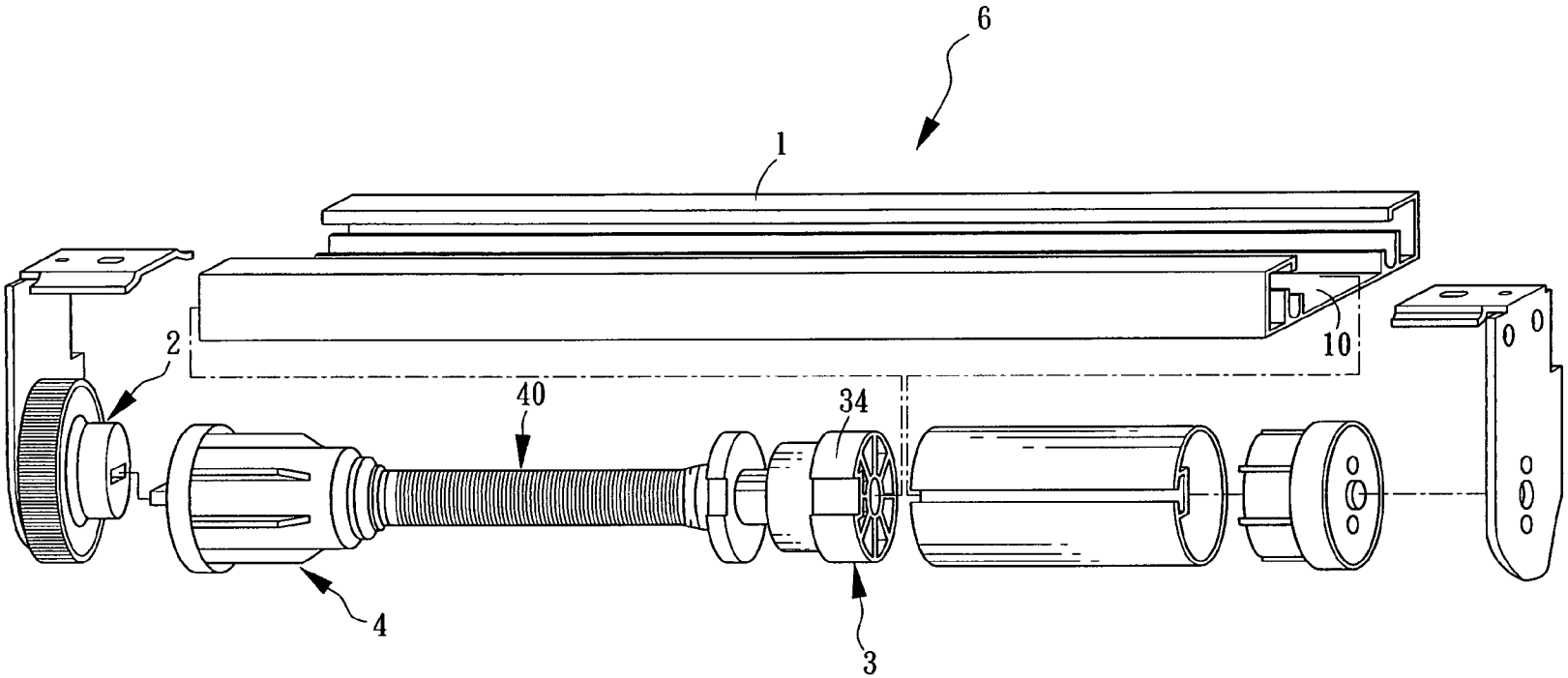
FIG. 1 is an exploded view of the invention.
Figure 2:
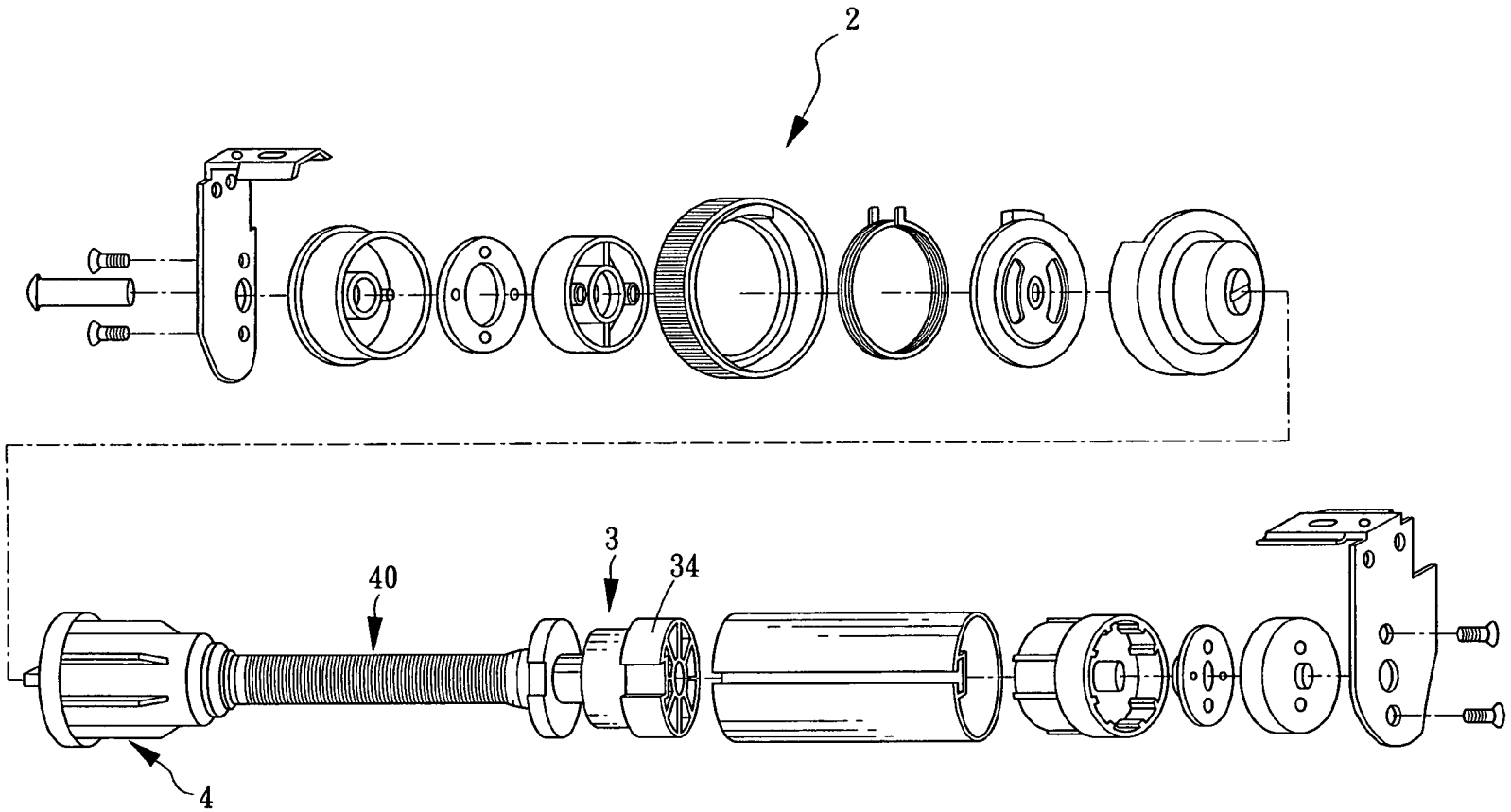
FIG. 2 is an exploded view of the invention, showing the adjusting means and rolling means.

Referring to FIGS. 1 and 2, the curtain rolling buffer apparatus 6 of the invention consists of a track 1, an adjusting means 2, a buffer means 3, a rolling means 4 and curtains.

The track 1 is formed substantially U-shape, and includes a U-shaped channel 10. The U-shaped channel 10 holds, from the left hand side to the right hand side, the adjusting means 2, the rolling means 4 (known in the art, thus details are omitted), an adjustable spring 40 and the buffer means 3.

Figure 3:
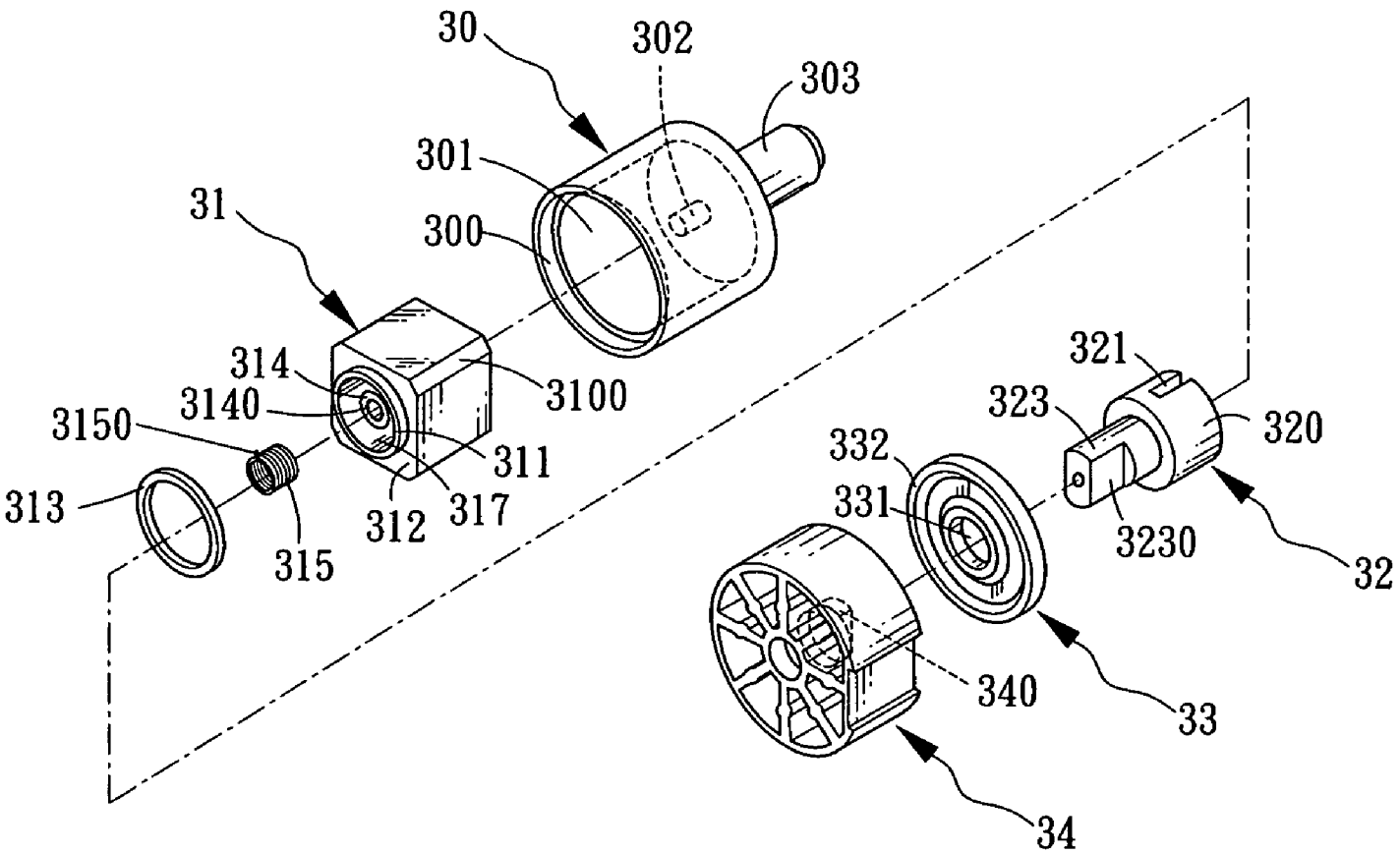
FIG. 3 is an exploded view of the buffer means of the invention.

Referring to FIGS. 2 and 3, the buffer means 3 includes a casing 30, a bushing 31, a hub 32, a cap 33 and a rotor 34.

The casing 30 has a strut 303 extended outwards from one end in the center with a cavity 3030 formed therein. Another end of the casing 30 has an annular indented recess 300 and a hollow interior 301. At the bottom side of the hollow interior 301, there is a stub shaft 302 for coupling with a round aperture 310 formed in one end of the bushing 31. The bushing 31 has chamfer corners 3100 to form small gaps 304 with the hollow interior 301. The peripheral sides of the bushing 31 and the hollow interior 301 form a first space 318 for containing lube oil 316.

The bushing 31 is housed in the hollow interior 301 of the casing 30, and has a round aperture 310 formed on one end in the center to couple with the stub shaft 302 of the casing 30, and an annular jutting ring 311 on another end extending outwards from the end surface 312 for coupling with an oil seal 313. The annular jutting ring 311 and oil seal 313 are encased by an annular retaining ring 330 formed on one end of the cap 33. The bushing 31 further has an axle 314 located in the center which has a center hole 3140 formed therein. The axle 314 is surrounded by a spring 315 on the periphery. The interior of the bushing 31 also has a second space 317 formed around the axle 314 to facilitate coupling of the hub body 320 of the hub 32.

The hub 32 has one end formed a hub body 320 which has a trough 321 formed on the periphery thereof. When the hub 32 is coupled with the bushing 31 in the second space 317, the strut 322 located on one end of the hub 32 is inserted into the center hole 3140 of the axle 314. The spring 315 has one end 3150 biased to engage with the trough 321. Hence when the hub 32 is turned clockwise or in a direction opposite to the winding direction of the spring, the spring 315 will tend to be unwound causing the diameter of the spring to be extended outwards, thus losing contact with the axle and running idle to facilitate the extending of the curtain. When the hub 32 is turned counterclockwise or in a direction of the winding of the spring 315 will tend to be wound tighter causing the diameter of the spring to be contracted thus tightening the contact between the spring and the axle turning with the bushing 31. The lube oil 316 located outside the bushing 31 will retard the turning of the bushing and generate a reaction force in the opposite direction by being forced to travel through gaps 304 as the bushing turns, thereby to slow down the rolling of the curtain. The hub 32 further has an elongated chamfer section 3230 extended from a rod 323 located on another end of the hub 32 to couple with a center opening 331 of the cap 33.

The rotor 34 has an elongated cavity 340 formed in the center of one end to house the elongated chamfer section 3230 of the hub 32.

Figure 4:
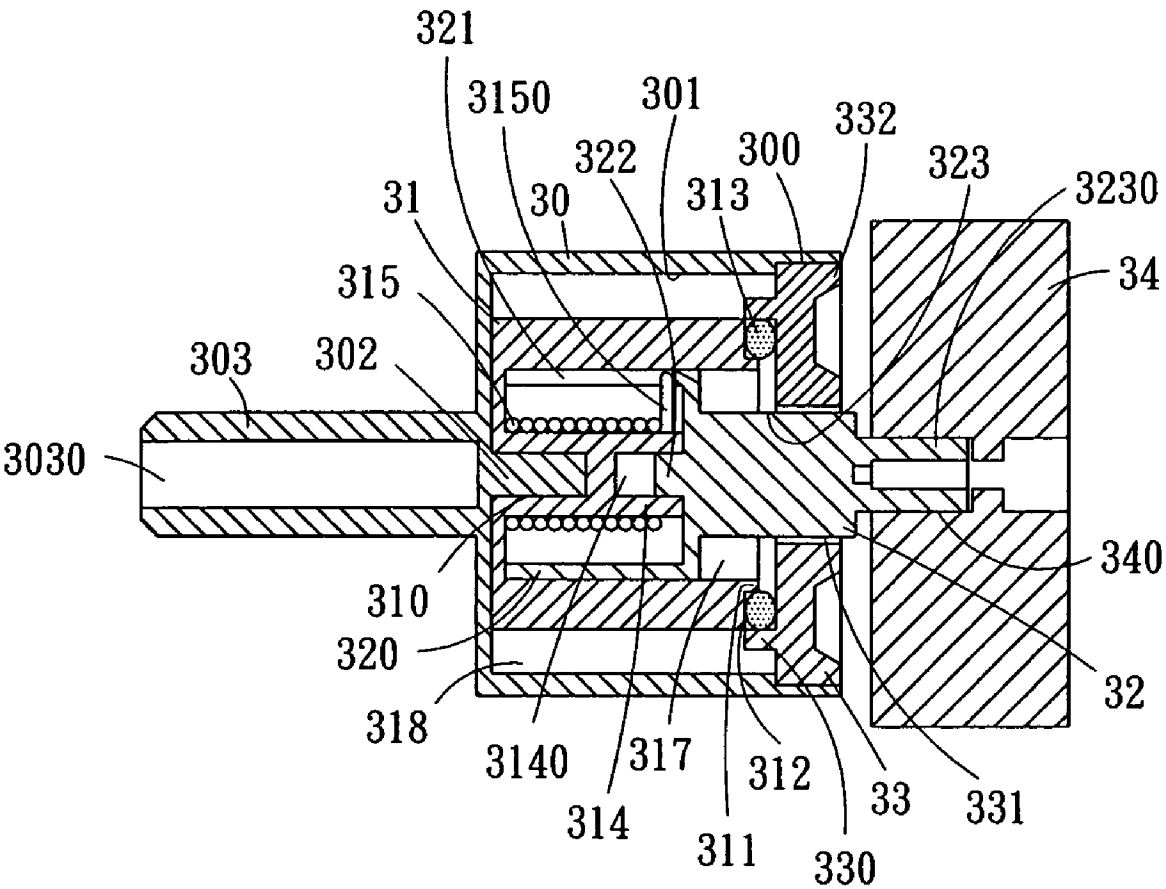
FIG. 4 is a sectional view of the buffer means of the invention.
Figure 5:
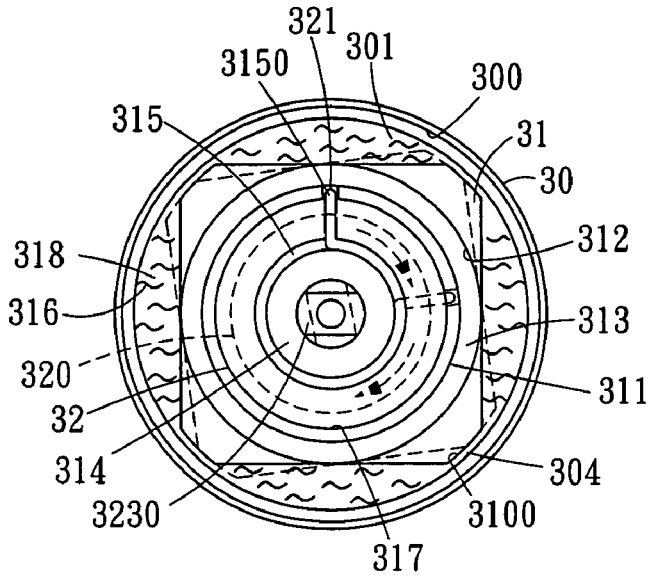
FIG. 5 is a schematic side view of the invention, with the bushing turning clockwise (for extending the curtain).
Figure 6:
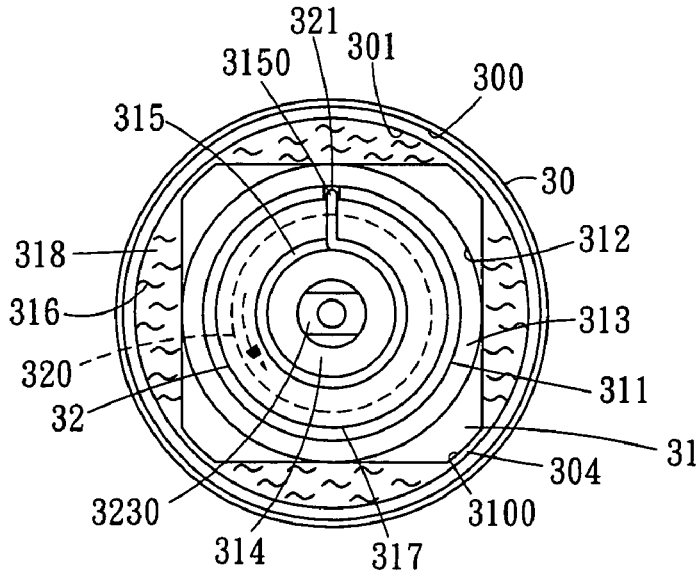
FIG. 6 is a schematic side view of the invention, with the bushing turning counterclockwise (for retracting the curtain).

With the buffer means 3 thus formed (referring to FIG. 4), when the curtain rolling buffer apparatus 6 that consists of the buffer means 3 is in use to extend a curtain, the spring 315 surrounding the axle 314 in the bushing 31 located on the right side of the track 1 and the hub 32 will be coupled and turned (clockwise, as shown in FIG. 5), the spring 315 is extended outwards and runs idle. As the spring force 315 is smaller than the lube oil 316 pressure, the curtain may be pulled and extended smoothly. On the contrary, when to wind and retract the curtain (turning counterclockwise, as shown in FIG. 6), the spring 315 in the bushing 31 is tightened and drives the bushing 31 to rotate together. But when the bushing 31 rotates counterclockwise, it is retarded by the lube oil 316 and generates a reaction force in the opposite direction. Hence the rolling speed of the curtain is reduced to prevent the curtain from forming creases or being damaged.

What is claimed is:

1. An improved curtain rolling buffer apparatus, comprising a casing, a bushing, a hub, a cap and a rotor, wherein:

the casing has a strut extending outwards from one end thereof having a cavity formed in the center therein, and an annular indented recess and a hollow interior formed on another end, the hollow interior having a bottom side with a stub shaft located thereon;

the bushing has a round aperture formed on one end in the center thereof to couple with the stub shaft of the casing, and an annular jutting ring extending outwards from an end surface of another end thereof;

the hub has a hub body on one end that has a trough formed on the periphery, and a rod on another end thereof with an elongated chamfer section formed thereon;

the cap has an annular retaining ring located on one end thereof to encase and press an oil seal located on the end surface of another end of the bushing to prevent the oil seal from falling out, and a cap rim located on another end to couple with the annular indented recess of the casing; and the rotor has an elongated cavity formed in the center of one end thereof to couple with the elongated chamfer section of the rod of the hub;

wherein during extending a curtain with the curtain rolling buffer apparatus, a spring surrounding an axle in the bushing and the hub are coupled and turned clockwise, the spring being extended outwards and running idle, and the spring force being smaller than the corresponding force due to the lube oil pressure in the first space such that the curtain is pulled and extended smoothly; on the contrary, during winding and retracting the curtain by turning counterclockwise, the spring in the bushing being tightened and driving the bushing to rotate together counterclockwise, the bushing being retarded by the lube oil and generating a reaction force in an opposite direction to reduce the winding speed to retract the curtain at a lower speed.

2. The improved curtain rolling buffer apparatus of claim 1, wherein the bushing further has the axle located in the center which has a center hole formed therein, the axle being surrounded by the spring on the periphery.

3. The improved curtain rolling buffer apparatus of claim 1, wherein the bushing has chamfer corners to form gaps with the hollow interior, the peripheral sides of the bushing and the hollow interior forming a space for containing the lube oil.

* * * * *